US005711924A

United States Patent [19]

Kiss

[11] Patent Number: 5,711,924

[45] Date of Patent: Jan. 27, 1998

[54] PROCESS FOR ELIMINATING ORGANIC POLLUTANT RESIDUES IN SYNTHESIS GAS OBTAINED DURING REFUSE GASIFICATION

[75] Inventor: Günter H. Kiss, Minusio, Switzerland

[73] Assignee: Thermoselect AG, Liechtenstein

[21] Appl. No.: 409,261

[22] Filed: Mar. 22, 1995

[30] Foreign Application Priority Data

Nov. 13, 1995 [EP] European Pat. Off. ..... 95101914

[51] Int. Cl.[6] ..... C01B 7/00; C01B 7/07

[52] U.S. Cl. ..... 423/240 R; 423/488; 423/DIG. 18

[58] Field of Search ..... 423/240 R, DIG. 18, 423/488; 48/197 A, 197 FM; 110/219

[56] References Cited

U.S. PATENT DOCUMENTS

| | | | |
|---|---|---|---|
| 4,021,193 | 5/1977 | Waters | 432/58 |
| 4,565,551 | 1/1986 | Okane et al. | 48/92 |
| 4,960,057 | 10/1990 | Ohshita et al. | 110/345 |
| 5,245,113 | 9/1993 | Schulz | 588/209 |

FOREIGN PATENT DOCUMENTS

| | | |
|---|---|---|
| 2815329 | 4/1978 | Germany . |
| 2834717 | 2/1979 | Germany . |

OTHER PUBLICATIONS

*Römps Chemie–Lexikon*, Franckh'sche Verlagshandlung Stuttgart, 1972, p. 414.

*Römps Chemie–Lexikon*, Franckh'sche Verlagshandlung Stuttgart, 1975, p. 3423.

*Primary Examiner*—Deborah Jones

*Attorney, Agent, or Firm*—Howard & Howard

[57] ABSTRACT

A process for eliminating organic pollutant residues in the synthesis gas occurring during refuse gasification by the addition of oxygen, in which at least prepyrolyzed, carbon-containing refuse in compressed form is fed into a high temperature reactor, where a loosely heaped gasification bed is formed and is burnt below the same by oxygen addition. The resulting synthesis gas is drawn off from the top area of the high temperature reactor after an adequate residence time and into the residence zone. Additional oxygen is then jetted in temperature-regulated, partial quantities in such a way that the resulting possible partial combustion of the synthesis gas maintains its temperature above the gasification bed constant at approximately 1000° C. Oxygen jetting takes place in such a way that a completely homogeneous gas mixing is ensured in the top area. For this purpose, several oxygen jets are arranged in the top area of the high temperature reactor and are axially and/or radially inclined thereto.

3 Claims, No Drawings

PROCESS FOR ELIMINATING ORGANIC POLLUTANT RESIDUES IN SYNTHESIS GAS OBTAINED DURING REFUSE GASIFICATION

TECHNICAL FIELD

The invention relates to a process for eliminating organic pollutant residues in synthesis gas obtained during gasification of refuse garbage with carbon-containing residual materials of all types.

BACKGROUND OF THE INVENTION

In the German language treatise by J. Schweitzer "Thermoselect Process For The Degasification And Gasification Of Waste", EF Verlag Energie und Umwelttechniek (1944), Berlin, ISBN 3-924511-47-0, a novel process is described, which has become known in the relevant technical press under the trademark and trade name "Thermoselect". According to this process carbon-containing residual materials, namely random, heterogeneously formed refuse, such as normal domestic refuse, is at least partly pyrolyzed, initially accompanied by compression, and is subsequently fed in the still compressed form into a high temperature reactor. In the furnace shaft the prepyrolyzed refuse, fed in crumbly manner, forms a loosely heaped gasification bed.

By adding oxygen or oxygen-enriched air to the column of the gasification bed, the carbon fractions present are oxidized and respectively gasified at temperatures of more than 2000° C. such as occur in the core of the gasification bed. The resulting $CO_2$ is largely reduced also to CO in a deoxidizing chamber above the heap, i.e. in the top area of the high temperature reactor, over the gasification bed at temperatures of at least 1000° C. At these temperatures the reaction equilibrium (producer-gas equilibrium) is displaced towards CO. As a result of the refuse moisture also introduced into the high temperature reactor in parallel to the producer-gas equilibrium reaction, the water gas reaction ($H_2O+C \rightarrow CO+H_2$) takes place. The synthesis gas obtained, which can be very economically used from a material and/or energy standpoint, consists in the case of such a temperature control mainly of CO, $H_2$ and small amounts of $CO_2$.

Organic pollutants, particularly the highly toxic dioxins or furans, are no longer stable at the temperature range in question and are with certainty cracked. The metallic and also mineral components of the refuse are melted in the lower burner zone and drawn off from the high temperature reactor. The exothermic oxidation reactions supply the energy necessary for this. The endothermic reactions crack the organic compounds and therefore in particular also the pollutant compounds. The chemical energy content and the freedom from pollutants of the synthesis gas provide a very advantageous basis for its industrial utilization. By means of shock cooling of the hot gas, any new formation of organic pollutants is prevented. The cracking of the pollutants in the free gas zone, i.e. the so-called deoxidizing chamber over the gasification bed of the high temperature reactor, requires precisely defined temperature conditions in each chamber portion, as well as clearly defined residence times.

There are in particular two conditions, which can impair the process. Firstly, as a result of the possibly widely differing refuse composition, particularly in the case of a high moisture content, the temperature of the synthesis gas in the residence chamber above the gasification bed can temporarily drop. Secondly, in the residence chamber above the gasification bed, laminar flow areas can form, which in partial zones reduce the synthesis gas residence time. These so-called gas strands or paths of laminar flow areas must always be avoided in the deoxidizing chamber. Thus, it is not possible to exclude in either case that traces of pollutants remain in the synthesis gas and are released during the utilization thereof. In view of the present aims of avoiding any possible risk in the case of waste material treatments, particularly in the heat treatment of refuse, the problem therefore arises of stabilizing the temperature in the gas zone above gasification bed of the high temperature reactor at least 1000° C. with a high degree of certainty and to exclude at any point in space laminar flow areas in the form of unwanted gas strands or paths.

SUMMARY OF THE INVENTION

According to the invention, this problem is solved by the subject process for eliminating organic pollutant residues in the synthesis gas occurring during refuse gasification by the addition of oxygen. At least prepyrolyzed carbon containing refuse in compressed form is fed into a high temperature reactor where a loosely heaped gasification bed is formed. Gasification by oxygen addition occurs below the loosely heaped gasification bed. The resulting synthesis gas is drawn off in the top area of the high temperature reactor after an adequate residence time. The process is characterized in that, into the free gas zone of the high temperature reactor, which free gas zone constitutes a residence zone in the top area of the reactor, is jetted additional oxygen in temperature gas controlled partial quantities in such a way that the resulting possible partial combustion of the synthesis gas maintains its temperature above the gasification bed constant at approximately 1000° C. and oxygen jetting takes place in such a way that a complete, homogeneous gas mixing in the top area is ensured.

DESCRIPTION OF THE PREFERRED EMBODIMENT

Due to the fact that into the deoxidizing chamber in the form of a free gas zone of the high temperature reactor additional oxygen is jetted in temperature-regulated, partial quantities, the temperature can be kept absolutely constant by a partial combustion of the synthesis gas. The jetting in of additional oxygen also offers the possibility of creating turbulence in the gas flow in the top area of the high temperature zone in such a way that there is no longer any formation of laminar flow areas, which could form the indicated "passages" for pollutants. In simple manner, additional turbulence can be obtained in the top area of the high temperature reactor in that use is made of several oxygen jets or nozzles for jetting in the partial oxygen quantity and are arranged in inclined manner axially and/or radially to the top area of the high temperature reactor.

If at least one oxygen jet has an injection nozzle for liquid or gaseous fuels associated with it, it is possible to maintain the temperature necessary for pollutant elimination in all cases, i.e. independently of other parameters.

What is claimed is:

1. A process for eliminating organic pollutant residues in the synthesis gas occurring during refuse gasification by the addition of oxygen, said process comprising:

a: feeding compressed, prepyrolyzed, carbon-containing refuse into a high temperature reactor having a top area whereby a loosely heaped gasification bed is formed;

b: initiating gasification by oxygen addition below the bed;

c: drawing off the resulting synthesis gas in the top area of the reactor after an adequate residence time; and d: jetting additional oxygen into a free gas zone in the top area of the reactor in temperature controlled, partial quantities whereby the synthesis gas at least partially combusts with the additional oxygen, the temperature above the gasification bed is constant at approximately 1000° C. and a complete homogeneous gas mixing in the top area is ensured.

2. The process according to claim 1 wherein the additional oxygen is jetted into the free gas zone via several oxygen jets in the top area of the reactor, said oxygen jets being axially and/or radially inclined thereto.

3. The process according to claim 1 wherein at least one oxygen jet has an injection nozzle for liquid or gaseous fuel associated therewith.

* * * * *

UNITED STATES PATENT AND TRADEMARK OFFICE

CERTIFICATE OF CORRECTION

PATENT NO. : 5,711,924

DATED : January 27, 1998

INVENTOR(S) : Gunter H. Kiss

It is certified that error appears in the above-indentified patent and that said Letters Patent is hereby corrected as shown below:

On the title page, item:

[30] Foreign Application Priority Data

Feb. 13, 1995 [EP] European Pat. Off. ..... 95101914

Signed and Sealed this

Eleventh Day of August 1998

Bruce Lehman

*Attest:*

BRUCE LEHMAN

*Attesting Officer*

*Commissioner of Patents and Trademarks*